US008744322B2

(12) United States Patent
Iwamura

(10) Patent No.: US 8,744,322 B2
(45) Date of Patent: Jun. 3, 2014

(54) DEVELOPING DEVICE AND IMAGE FORMING APPARATUS

(75) Inventor: Takuya Iwamura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 171 days.

(21) Appl. No.: 13/280,785

(22) Filed: Oct. 25, 2011

(65) Prior Publication Data

US 2012/0243911 A1 Sep. 27, 2012

(30) Foreign Application Priority Data

Mar. 25, 2011 (JP) ..... 2011-068744

(51) Int. Cl.
*G03G 15/09* (2006.01)

(52) U.S. Cl.
USPC ..... 399/277; 399/267; 399/272

(58) Field of Classification Search
USPC ..... 399/277, 267, 272, 274, 275
See application file for complete search history.

(56) References Cited

U.S. PATENT DOCUMENTS

2008/0267672 A1* 10/2008 Matsumoto et al. ..... 399/274
2010/0008702 A1* 1/2010 Park ..... 399/274
2010/0098463 A1* 4/2010 Matsumoto et al.

FOREIGN PATENT DOCUMENTS

JP A-2002-148921 5/2002
JP A-2003-307924 10/2003
JP A-2009-237430 10/2009

* cited by examiner

*Primary Examiner* — Sophia S Chen
(74) *Attorney, Agent, or Firm* — Oliff PLC

(57) ABSTRACT

A developing device includes a developing member including a scooping pole generating the magnetic lines of force to scoop up a developer, rotating while holding the developer scooped up by the scooping pole on a surface thereof, and supplying the developer to an image holding body to develop the electrostatic latent image, and an agitation transport unit that is disposed at a position where a developer used for development and separated and falling from the developing member is received, rotates about a rotating shaft extending along a rotating shaft of the developing member, agitates the developer, and transports the agitated developer to a scoop position, wherein the scooping pole is disposed on the downstream side of a line, which connects the rotating shaft of the developing member with the rotating shaft of the agitation transport unit, in a rotation direction of the developing member.

9 Claims, 6 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2011-068744 filed Mar. 25, 2011.

BACKGROUND

Technical Field

The present invention relates to a developing device and an image forming apparatus.

SUMMARY

According to an aspect of the invention, there is provided a developing device including: a developing member that includes a scooping pole generating the magnetic lines of force to scoop up a developer, rotates while holding the developer scooped up by the scooping pole on a surface thereof, and supplies the developer to an image holding body on which an electrostatic latent image is formed to develop the electrostatic latent image; and an agitation transport unit that is disposed at a position where a developer used for development and separated and falling from the developing member is received, rotates about a rotating shaft, which extends along a rotating shaft of the developing member, as a center, agitates the developer, and transports the agitated developer to a scoop position where the developer is scooped up by the scooping pole, wherein the scooping pole is disposed on the downstream side of a line, which connects the rotating shaft of the developing member with the rotating shaft of the agitation transport unit, in a rotation direction of the developing member when seen in a rotation axis direction of the developing member.

BRIEF DESCRIPTION OF THE DRAWINGS

Exemplary embodiments of the present invention will be described in detail based on the following figures, wherein.

DETAILED DESCRIPTION

A developing device and an image forming apparatus according to exemplary embodiments of the invention will be described below with reference to the accompanying drawings.

(Entire Configuration)

Figure 1:
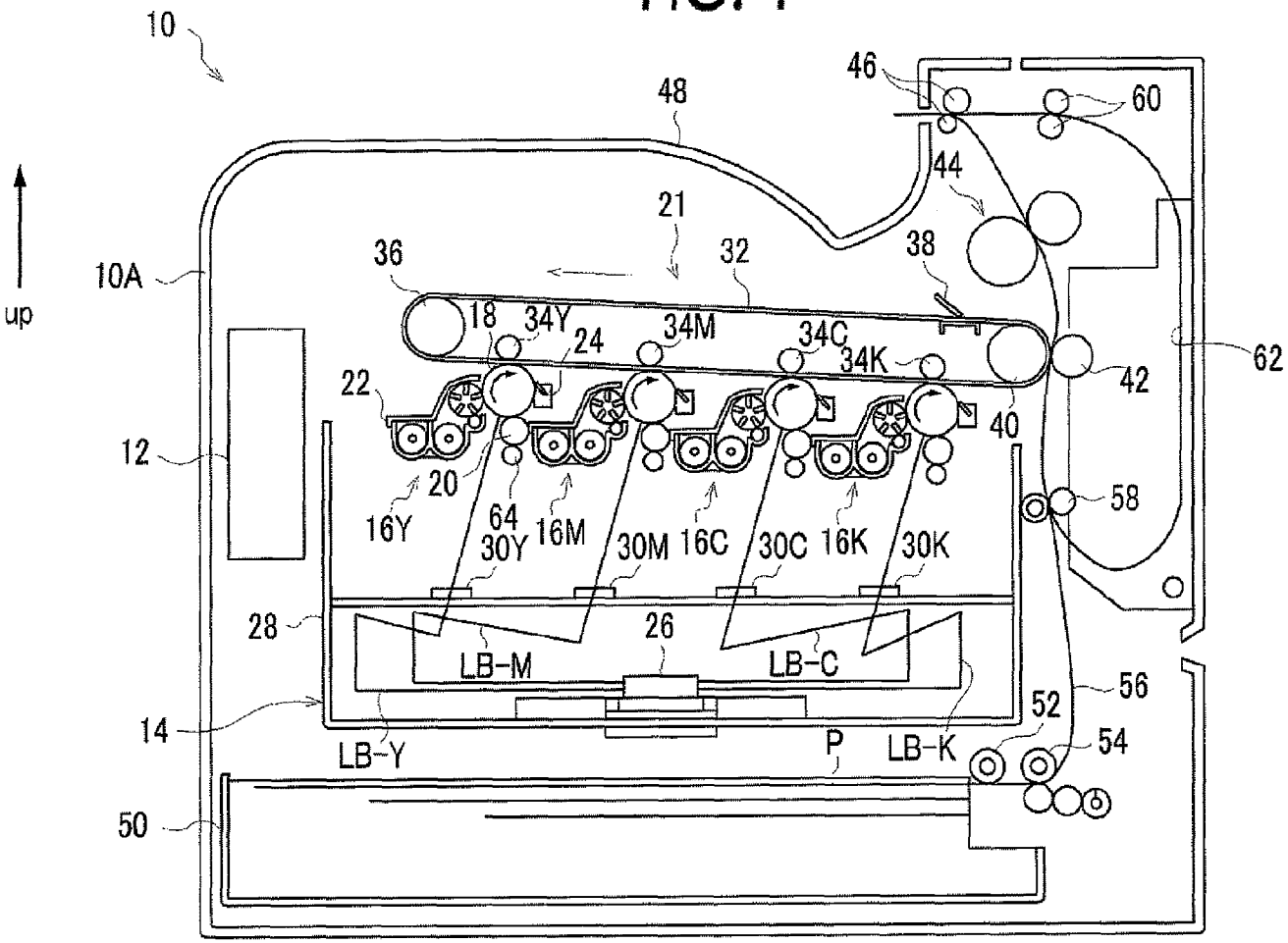
FIG. 1 is a configurational diagram of an image form apparatus according to an exemplary embodiment of the invention.

As shown in FIG. 1, an image processing unit 12, which performs the image processing of image data to be input, is provided in an apparatus body 10A of an image forming apparatus 10.

The image processing unit 12 processes the input image data into gray scale data corresponding to four colors, that is, yellow (Y), magenta (M), cyan (C), and black (K). An exposure device 14, which receives the processed gray scale data and performs image exposure using laser beams LB, is provided at the central portion in the apparatus body 10A.

Further, four image forming units 16Y, 16M, 16C, and 16K corresponding to yellow (Y), magenta (M), cyan (C), and black (K) are disposed above the exposure device 14 at intervals in the substantially horizontal direction. Hereinafter, when Y, M, C, and K do not need to be distinguished from each other in the description, reference letters Y, M, C, and K may be omitted.

All of these four image forming units 16Y, 16M, 16C, and 16K have the same configuration. Each of the image forming units includes a columnar image holding body 18, a charging member 20 for primary charging, a developing device 22, a cleaning blade 24, and the like. The columnar image holding body 18 is rotationally driven at a predetermined speed. The charging member 20 for primary charging charges the outer peripheral surface of the image holding body 18. The developing device 22 visualizes an electrostatic latent image, which is formed on the charged outer peripheral surface of the image holding body 18, as a toner image by developing the electrostatic latent image with a predetermined color toner through the image exposure of the above-mentioned exposure device 14. The cleaning blade 24 cleans the outer peripheral surface of the image holding body 18. Further, a cleaning member 64, which cleans the outer peripheral surface of the charging member 20 while coming into contact with the columnar charging member 20, is provided below the charging member 20.

Further, the exposure device 14 is provided with four semiconductor lasers (not shown) that have the configuration common to the four image forming units 16Y, 16M, 16C, and 16K. Laser beams LB-Y, LB-M, LB-C, and LB-K are emitted from these semiconductor lasers in accordance with gray scale data.

Meanwhile, the laser beams LB-Y, LB-M, LB-C, and LB-K emitted from the semiconductor lasers are radiated to a polygon mirror 26, which is a rotating polygon mirror, through an f-O lens (not shown) and are deflected and scanned by the polygon mirror 26. Further, the laser beams LB-Y, LB-M, LB-C, and LB-K, which are deflected and scanned by the polygon mirror 26, are scanned and exposed obliquely from below to exposure points on the image holding bodies 18 through an imaging lens and plural mirrors (not shown).

Furthermore, the periphery of the exposure device 14 is sealed by a rectangular parallelepiped frame 28. Moreover, windows 30Y, 30M, 30C, and 30K, which are made of transparent glass and transmit four laser beams LB-Y, LB-M, LB-C, and LB-K toward the image holding bodies 18 of the respective image forming units 16Y, 16M, 16C, and 16K, are provided on the upper portion of the frame 28.

Meanwhile, a transfer unit 21 is provided above the respective image forming units 16Y, 16M, 16C, and 16K. Further, the transfer unit 21 includes an intermediate transfer belt 32 as an example of an endless transfer object body; a driving roll 40 where the intermediate transfer belt 32 is wound and which is rotationally driven and revolves the intermediate transfer belt 32 in the direction of an arrow; a tensioning roll 36 where the intermediate transfer belt 32 is wound and which applies tension to the intermediate transfer belt 32; a cleaning blade 38 that cleans the outer peripheral surface of the intermediate transfer belt 32; and primary transfer rolls 34Y, 34M, 34C, and 34K as an example of transfer devices that are disposed on one side of the intermediate transfer belt opposite to the image holding bodies 18Y, 18M, 18C, and 18K with the intermediate transfer belt 32 interposed therebetween.

The respective color toner images, which correspond to yellow (Y), magenta (M), cyan (C), and black (K) and are sequentially formed on the image holding bodies 18 of the image forming units 16Y, 16M, 16C, and 16K, are multiply transferred to the intermediate transfer belt 32 by the four primary transfer rolls 34Y, 34M, 34C, and 34K.

Further, a secondary transfer roll 42 as an example of a transfer device is provided on one side of the intermediate transfer belt opposite to the driving roll 40 with the intermediate transfer belt 32 interposed therebetween. The respective color toner images, which correspond to yellow (Y), magenta (M), cyan (C), and black (K) and are multiply transferred to the intermediate transfer belt 32, are transported by the intermediate transfer belt 32, are interposed between the driving roll 40 and the secondary transfer roll 42, and are secondarily transferred to a sheet member P as an example of a transfer object body to be transported along a transport path 56.

Furthermore, a fixing device 44, which fixes the toner images transferred to the sheet member P to the sheet member P by heat and pressure, is provided on the downstream side of the secondary transfer roll 42 in the transport direction of the sheet member P.

Moreover, discharge rolls 46, which discharge the sheet member P to which the toner images have been fixed to a discharge section 48 provided at the upper portion of the apparatus body 10A of the image forming apparatus 10, are provided on the downstream side of the fixing device 44.

Meanwhile, a sheet feeding member 50 in which sheet members P are stacked is provided on the lower side in the apparatus body 10A of the image forming apparatus 10. In addition, a sheet feeding roll 52, which feeds the sheet members P stacked in the sheet feeding member 50 to the transport path 56, is provided and a separation roll 54, which separates and transports the sheet members P one by one, is provided on the downstream side of the sheet feeding roll 52. Further, a positioning roll 58, which adjusts a transport timing, is provided on the downstream side of the separation roll 54. Accordingly, a sheet member P supplied from the sheet feeding member 50 is fed to a position (secondary transfer position), where the intermediate transfer belt 32 and the secondary transfer roll 42 come into contact with each other, at a predetermined timing by the rotating positioning roll 58.

Furthermore, transport rolls 60, which do not discharge a sheet member P where toner images have been fixed to one surface by the fixing device 44 onto the discharge section 48 by the discharge rolls 46 as it is and transport the sheet member to a sheet transport path 62 for double-sided printing, are provided near the discharge rolls 46. Accordingly, the sheet member P, which is transported along the sheet transport path 62 for double-sided printing, is transported to the positioning roll 58 again while having been inverted. This time, toner images are transferred and fixed to the back of the sheet member P and the sheet member P is then discharged onto the discharge section 48.

An image is formed on the sheet member P as described below due to this configuration.

First, gray scale data corresponding to the respective colors are sequentially output to the exposure device 14 from the image processing unit 12, and laser beams LB-Y, LB-M, LB-C, and LB-K, which are emitted from the exposure device 14 in accordance with the gray scale data, are scanned and exposed to the outer peripheral surfaces of the image holding bodies 18 that are charged by the charging members 20, so that electrostatic latent images are formed on the outer peripheral surfaces of the image holding bodies 18. The electrostatic latent images formed on the image holding bodies 18 are visualized as the respective color toner images, which correspond to yellow (Y), magenta (M), cyan (C), and black (K), by the developing devices 22Y, 22M, 22C, and 22K, respectively.

Moreover, the respective color toner images, which correspond to yellow (Y), magenta (M), cyan (C), and black (K) and are formed on the image holding bodies 18, are multiply transferred to the revolving intermediate transfer belt 32 by the primary transfer rolls 34 of the transfer unit 21 that are disposed over the respective image forming units 16Y, 16M, 16C, and 16K.

Further, the respective color toner images, which have been multiply transferred to the revolving intermediate transfer belt 32, are secondarily transferred to the sheet member P, which is transported to the transport path 56 from the sheet feeding member 50 at a predetermined timing by the sheet feeding roll 52, the separation roll 54, and the positioning roll 58, by the secondary transfer roll 42.

Furthermore, the sheet member P to which the toner images have been transferred is transported to the fixing device 44. The toner images transferred to the sheet member P are fixed to the sheet member P by the fixing device 44. After the toner images are fixed to the sheet member P, the sheet member P is discharged onto the discharge section 48, which is provided at the upper portion of the apparatus body 10A of the image forming apparatus 10, by the discharge rolls 46.

In addition, when images are to be formed on both surfaces of a sheet member P, a sheet member P, where toner images have been fixed to one surface by the fixing device 44, is transported to the sheet transport path 62 for double-sided printing through the transport rolls 60 after the switching of the transport direction of the sheet member without being discharged onto the discharge section 48 as it is by the discharge rolls 46. Further, the sheet member P is transported along the sheet transport path 62 for double-sided printing, so that the sheet member P is inverted. Then, the sheet member P is transported to the positioning roll 58 again. This time, the sheet member P is discharged onto the discharge section 48 by the discharge rolls 46 after toner images are transferred and fixed to the back of the sheet member P.

(Configuration of Main Parts)

Figure 2:
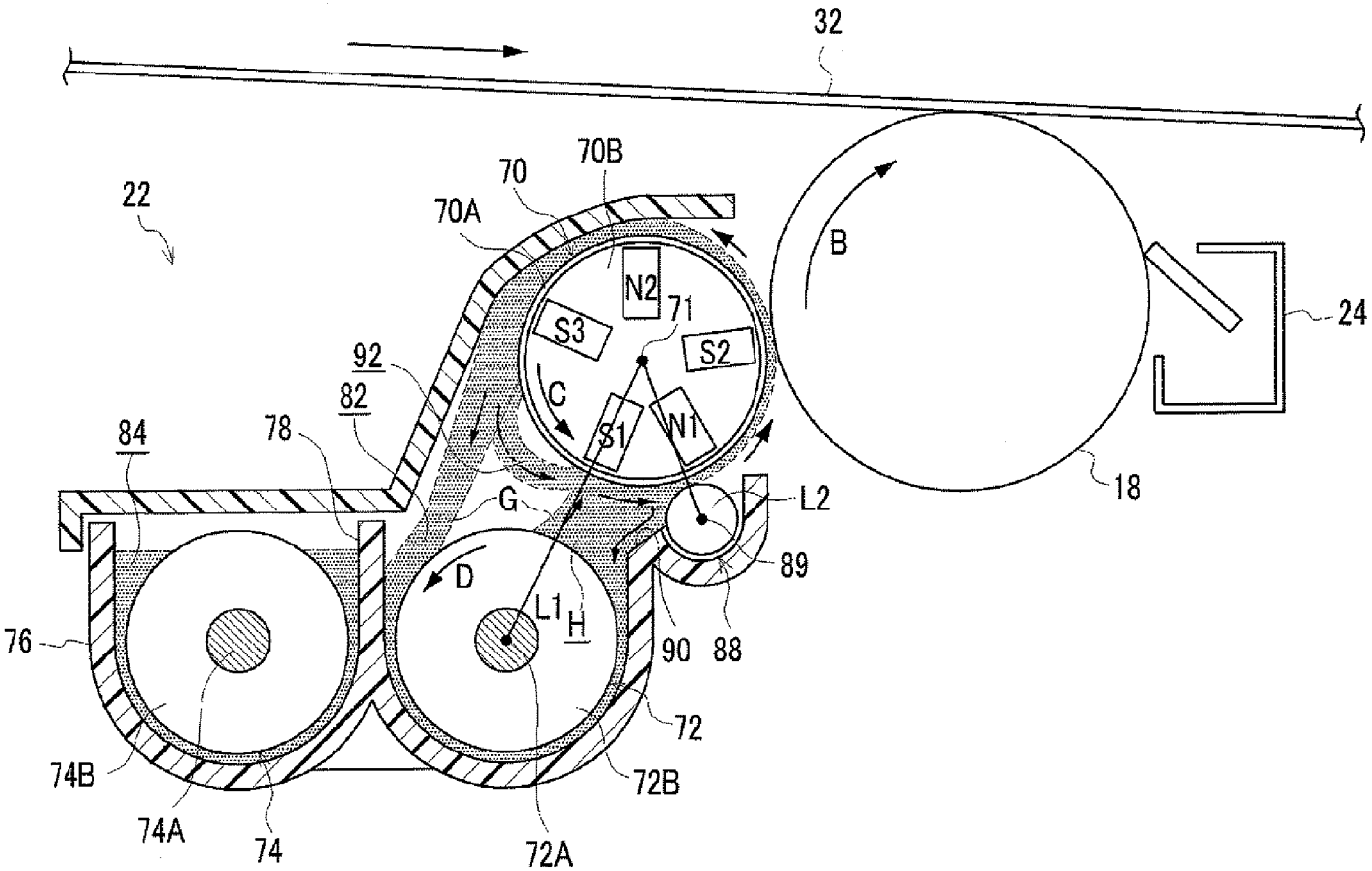
FIG. 2 is a configurational diagram of a developing device according to an exemplary embodiment of the invention.

As shown in FIG. 2, each of the developing devices 22 includes a developing roller 70 as an example of a developing member that is disposed so as to face the image holding body 18; a first agitation transport auger 72 as an example of an agitation transport unit that is disposed below the developing roller 70 and supplies a two-component developer G (hereinafter, simply referred to as a developer G) to the developing roller 70; a second agitation transport auger 74 that is disposed near the first agitation transport auger 72; and a housing 76 that houses the developing roller 70, the first agitation transport auger 72, and the second agitation transport auger 74. Meanwhile, the developer G contains a toner and a magnetic carrier as main components.

In addition, the first and second agitation transport augers 72 and 74 include rotating shafts 72A and 74A that extend along a rotating shaft 71 of the developing roller 70 and are rotatably supported by the housing 76, respectively. Further, spiral blades 72B and 74B are formed on the rotating shafts 72A and 74A of the first and second agitation transport augers 72 and 74 in a spiral shape at a predetermined pitch.

Furthermore, gears (not shown) are fixed to the end portions of the rotating shafts 72A and 74A, respectively. Accordingly, when torque is transmitted to the gears from a motor (not shown) and the first and second agitation transport augers 72 and 74 are rotated by the gears, the developer G stored in the housing 76 is transmitted while being agitated by the spiral blades 72B and 74B.

In detail, a partition wall 78, which protrudes from the bottom of the housing 76, is formed between the first and second agitation transport augers 72 and 74. A first agitation passage 82 in which the first agitation transport auger 72 is disposed and a second agitation passage 84 in which the second agitation transport auger 74 is disposed are formed by the partition wall 78. In addition, both end portions of the partition wall 78 in the longitudinal direction (the direction perpendicular to the plane of FIG. 2) are opened, so that the first and second agitation passages 82 and 84 are connected to each other.

Due to this configuration, the developer G is transported while being agitated in the first and second agitation passages 82 and 84 by the rotation of the first and second agitation transport augers 72 and 74. Accordingly, the developer is circulated between the first and second agitation passages 82 and 84.

The developing roller 70 is disposed so that a gap (development gap) is formed between the image holding body 18 and the developing roller. The developing roller 70 includes a columnar magnetic roller 70B that is non-rotatably supported by the housing 76 and a rotation sleeve 70A that covers the magnetic roller 70B and is rotated around the magnetic roller 70B.

The rotation sleeve 70A includes a rotating shaft 71 that is rotated in the direction of an arrow C shown in FIG. 2 around the magnetic roller 70B about the columnar shaft of the magnetic roller 70B as a center. The rotation sleeve 70A is rotated in the direction opposite to the rotation direction of the image holding body 18 that is rotated in the direction of an arrow B and is rotated in the same direction as the first agitation transport auger 72 that is rotated in the direction of an arrow D.

Five permanent magnets, which form S poles and N poles in the circumferential direction of the rotation sleeve 70A at portions close to the surface of the rotation sleeve 70A, are radially formed in the magnetic roller 70B. Further, a development pole 52 is disposed at the position facing the image holding body 18. Furthermore, magnetic poles are disposed so that a transport pole N2 is disposed near the development pole S2, a separation pole 53 is disposed near the transport pole N2, and a scooping pole S1 and a layer thickness regulating pole N1 are disposed near the separation pole S3 in this order in the rotation direction of the rotation sleeve 70A.

The scooping pole S1 is disposed so as to be offset to the downstream side of a line L1, which connects the rotating shaft 71 of the rotation sleeve 70A with the rotating shaft 72A of the first agitation transport auger 72, in the rotation direction of the rotation sleeve 70A. Here, "offset" means that a center line extending in the longitudinal direction of the scooping pole S1 is on one side (downstream side) of an objective line (line L1). The scooping pole S1 generates the magnetic lines of force that scoop up the developer G.

Each of the development pole S2, the separation pole S3, and the scooping pole S1 is an S pole, and each of the transport pole N2 and the layer thickness regulating pole N1 is an N pole. Meanwhile, a negative developing bias voltage is applied to the developing roller 70.

In addition, a columnar layer thickness regulating member 88, which is formed of a magnetic member, is provided at the position that is on the downstream side of the scooping pole S1 in the rotation direction of the rotation sleeve 70A and faces the rotation sleeve 70A. The layer thickness regulating member 88 is disposed so that a cylindrical shaft 89 of the layer thickness regulating member extends along the rotating shaft 71 of the rotation sleeve 70A. Both ends of the layer thickness regulating member 88 are non-rotatably supported by the housing 76.

The layer thickness regulating pole N1 is provided at the position facing the layer thickness regulating member 88, but is disposed so as to be offset to the downstream side of a line L2, which connects the cylindrical shaft 89 of the layer thickness regulating member 88 with the rotating shaft 71 of the rotation sleeve 70A, in the rotation direction of the rotation sleeve 70A (hereinafter, simply referred to as the rotation direction). Here, "offset" means that a center line extending in the longitudinal direction of the layer thickness regulating pole N1 is on one side (downstream side) of an objective line (line L2).

A guide surface 90 for guiding a surplus developer G, which comes into contact with the layer thickness regulating member 88 and turns around the layer thickness regulating member, to the first agitation passage 82 is formed on the inner surface of the housing 76. The guide surface 90 is formed so as to face the outer surface of the rotation sleeve 70A, and the developer G is interposed between the guide surface 90 and the outer surface of the rotation sleeve 70A.

As shown in FIG. 2, a developer G is transported while being agitated in the first and second agitation passages 82 and 84 by the rotation of the first and second agitation transport augers 72 and 74. Accordingly, the developer G is circulated between the first and second agitation passages 82 and 84. Further, the agitated developer G is transported to a scoop position H, where the developer is scooped up by the scooping pole S1, by the first agitation transport auger 72.

When the rotation sleeve 70A is rotated in the direction of the arrow C, first, the developer G existing at the scoop position H in the first agitation passage 82 is scooped up by the scooping pole S1 and adheres to the surface of the rotation sleeve 70A.

The magnetic lines of force directed to the development pole S2 from the layer thickness regulating pole N1, the magnetic lines of force directed to the development pole S2 from the transport pole N2, the magnetic lines of force directed to the separation pole S3 from the transport pole N2, and the magnetic lines of force directed to the scooping pole S1 from the layer thickness regulating pole N1, are formed on the surface of the rotation sleeve 70A. The developer G, which adheres to the surface of the rotation sleeve 70A, is arranged on the surface of the rotation sleeve 70A in the direction of the magnetic lines of force. That is, a magnetic brush, which is formed of the developer G arranged in the direction of the magnetic lines of force, is formed on the surface of the rotation sleeve 70A. Further, since the layer thickness regulating member 88 formed of a magnetic member is formed at the position facing the layer thickness regulating pole N1, the layer thickness regulating pole N1 generates the magnetic lines of force directed to the layer thickness regulating member 88.

The magnetic brush, which is formed on the surface of the rotation sleeve 70A in the vicinity of the scooping pole S1, is transported toward the layer thickness regulating pole N1 as the rotation sleeve 70A is rotated in the direction of the arrow C.

Here, the layer thickness regulating member 88 is provided between the scooping pole S1 and the layer thickness regulating pole N1 so as to face the rotation sleeve 70A with a predetermined gap between the layer thickness regulating member 88 and the rotation sleeve 70A. The developer G, which is transported toward the layer thickness regulating pole N1 by the rotation sleeve 70A rotating in the direction of the arrow C, comes into contact with the layer thickness regulating member 88, so that the layer thickness of the developer G is regulated.

Specifically, the developer G, which is to pass through the gap between the layer thickness regulating member 88 and the rotation sleeve 70A, is attracted by the layer thickness regulating pole N1 that is disposed on the downstream side of the layer thickness regulating member 88 in the rotation direction. Accordingly, the developer G does not stay at the gap between the layer thickness regulating member 88 and the rotation sleeve 70A and the layer thickness of the developer G on the rotation sleeve 70A is regulated, so that the height of the magnetic brush is made uniform.

Meanwhile, the surplus developer G, which cannot pass through the gap between the layer thickness regulating member 88 and the rotation sleeve 70*a*, comes into contact with the layer thickness regulating member 88, turns around the layer thickness regulating member, and flows along the guide surface 90 so as to be returned to the first agitation passage 82.

The developer G of which the layer thickness has been regulated by the layer thickness regulating member 88 is transported to the layer thickness regulating pole N1, the development pole S2, the transport pole N2, and the separation pole S3 in this order.

The toner of the developer G is supplied to the image holding body 18 in the vicinity of the development pole S2, the electrostatic latent image formed on the image holding body 18 is visualized as a toner image, and the developer G mostly formed as might be expected from the magnetic carrier (of which the toner concentration has been reduced) remains on the surface of the rotation sleeve 70A. The scooping pole S1 and the separation pole 53 are the same poles, and the magnetic lines of force are not formed on the surface of the rotation sleeve 70A between the scooping pole S1 and the separation pole S3. For this reason, the developer G of which the toner concentration has been reduced and which has been used for development is separated and falls from the surface of the rotation sleeve 70A between the separation pole S3 and the scooping pole S1 as the rotation sleeve 70A is rotated. The developer G, which has been separated and fallen, is returned to the first agitation transport auger 72 that is disposed at the position where the developer is received. The developer G, which has been returned to the first agitation transport auger 72, is agitated together with surrounding developer G in the first and second agitation passages 82 and 84, so that the toner concentration of the developer is recovered.

Here, since the first agitation transport auger 72 is provided at the lower portion where the developer G having been used for development is separated and falls, the developer G having been used for development is separated and falls so as to be distant from the scooping pole S1. However, if the fluidity of the developer G deteriorates due to a change in the environment of the image forming apparatus 10, a point where the developer G having been used for development is separated and falls is deviated to the downstream side in the rotation direction of the rotation sleeve 70A like a flow 92 of the developer G shown by an imaginary line in FIG. 2. Accordingly, a part of the developer G having been used for development does not fall to the first agitation transport auger 72 and is scooped up by the scooping pole S1 without being agitated and transported by the first or second agitation transport auger 72 or 74. If the developer G having been used for development is scooped up without being agitated, density unevenness is generated during the development of an electrostatic latent image.

Figure 3:
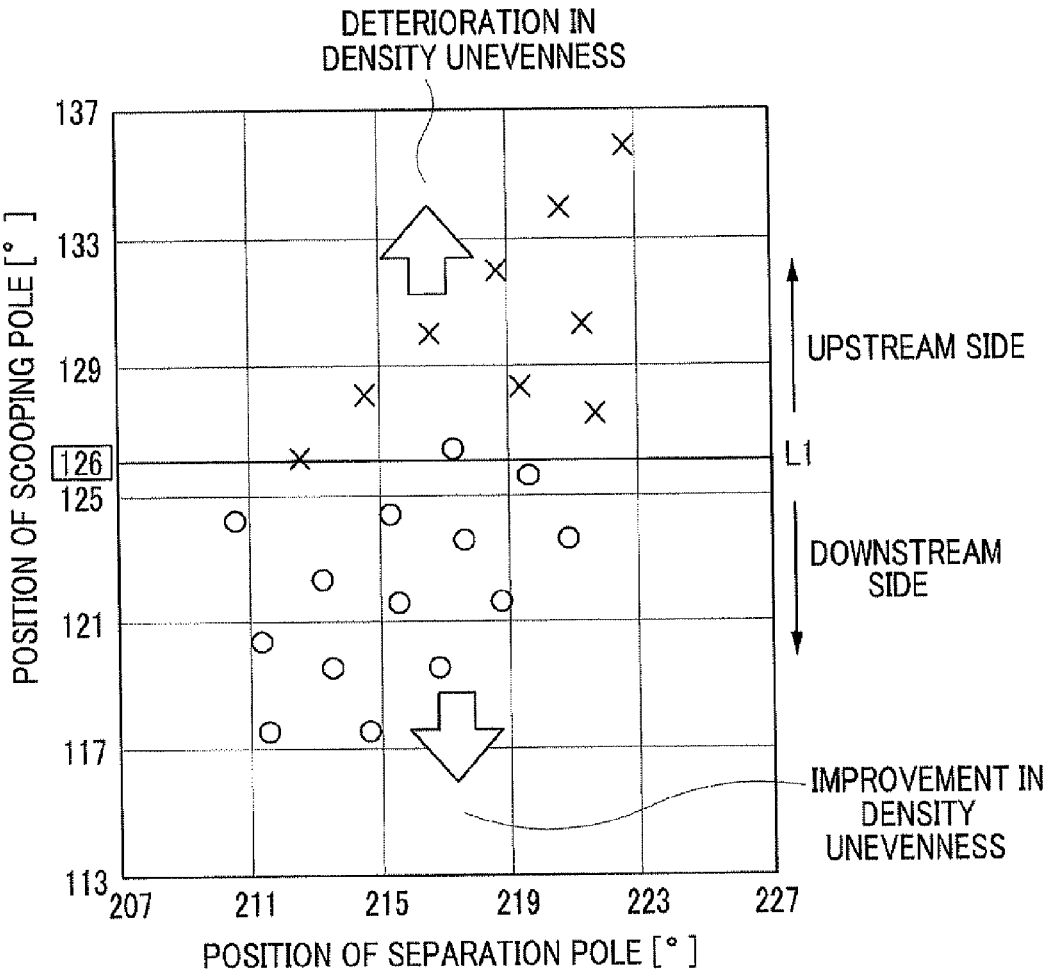
FIG. 3 is a graph showing the presence or absence of the generation of density unevenness when the positions of a scooping pole and a separation pole of the developing device according to the exemplary embodiment of the invention are changed variously.

FIG. 3 is a graph showing the presence or absence of the generation of density unevenness when the positions of the scooping pole S1 and the separation pole S3 are changed variously. A vertical axis represents the position of the scooping pole S1, a horizontal axis presents the position of the separation pole S3, a circle symbol represents that density unevenness is not generated, and a cross symbol represents that density unevenness is generated. The positions of the scooping pole S1 and the separation pole S3 are represented as an angular position in the clockwise direction when the angular position of the development pole S2 is assumed as 0°.

As shown in FIG. 3, it is found that the presence or absence of density unevenness is switched at the angular position of the scooping pole S1 corresponding to about 126°. Here, the angular position of 126° is a position corresponding to the line L1 (see FIG. 2) that connects the rotating shaft 71 of the rotation sleeve 70A with the rotating shaft 72A of the first agitation transport auger 72.

For this reason, as described above, the scooping pole S1 of the developing device 22 according to this exemplary embodiment is disposed so as to be offset to the downstream side of the line L1, which connects the rotating shaft 71 of the rotation sleeve 70A with the rotating shaft 72A of the first agitation transport auger 72, in the rotation direction of the rotation sleeve 70A. Accordingly, the scoop-up of the developer G having been used for development, which is performed by the scooping pole S1 without the agitation and transport of the developer performed by the first or second agitation transport auger 72 or 74, is suppressed, so that the generation of density unevenness in the development of the electrostatic latent image is suppressed.

Figure 4:
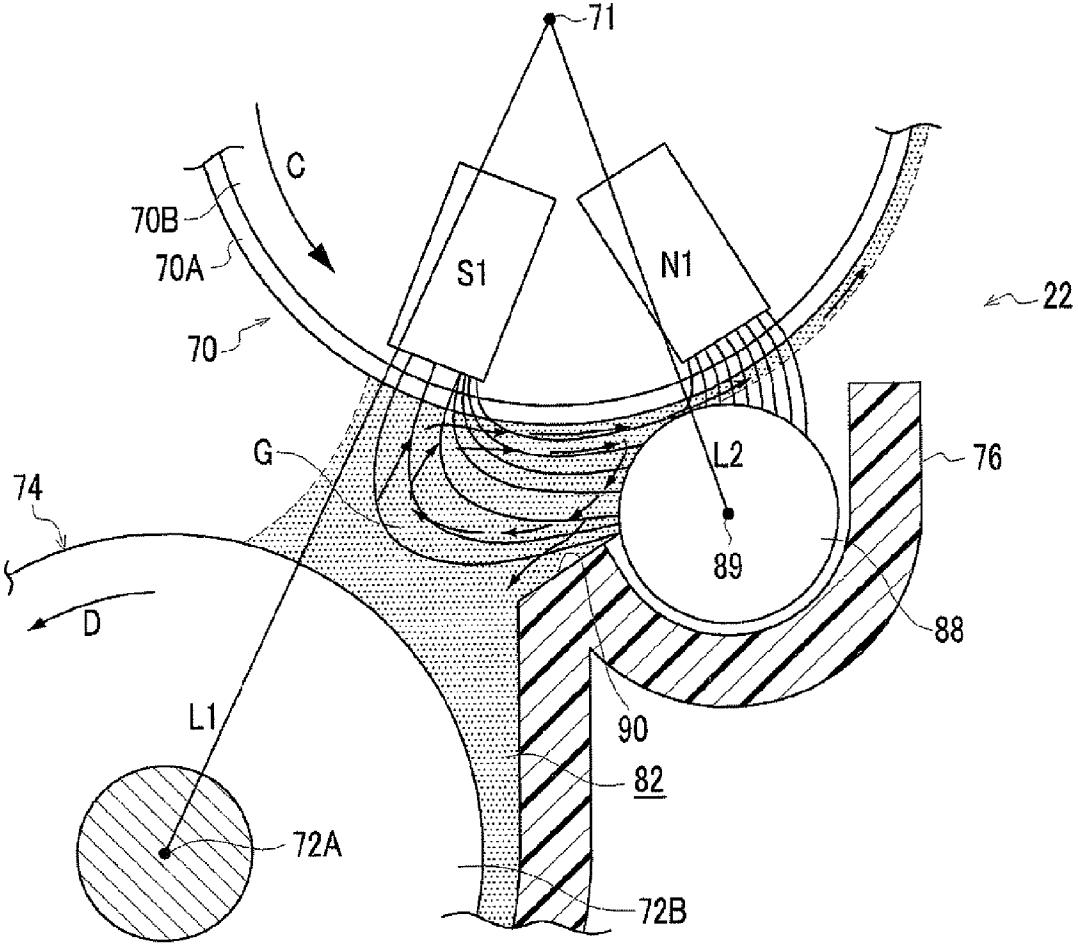
FIG. 4 is a view showing the flow of a developer and the magnetic lines of force in the vicinity of the scooping pole of the developing device according to the exemplary embodiment of the invention.
Figure 5:
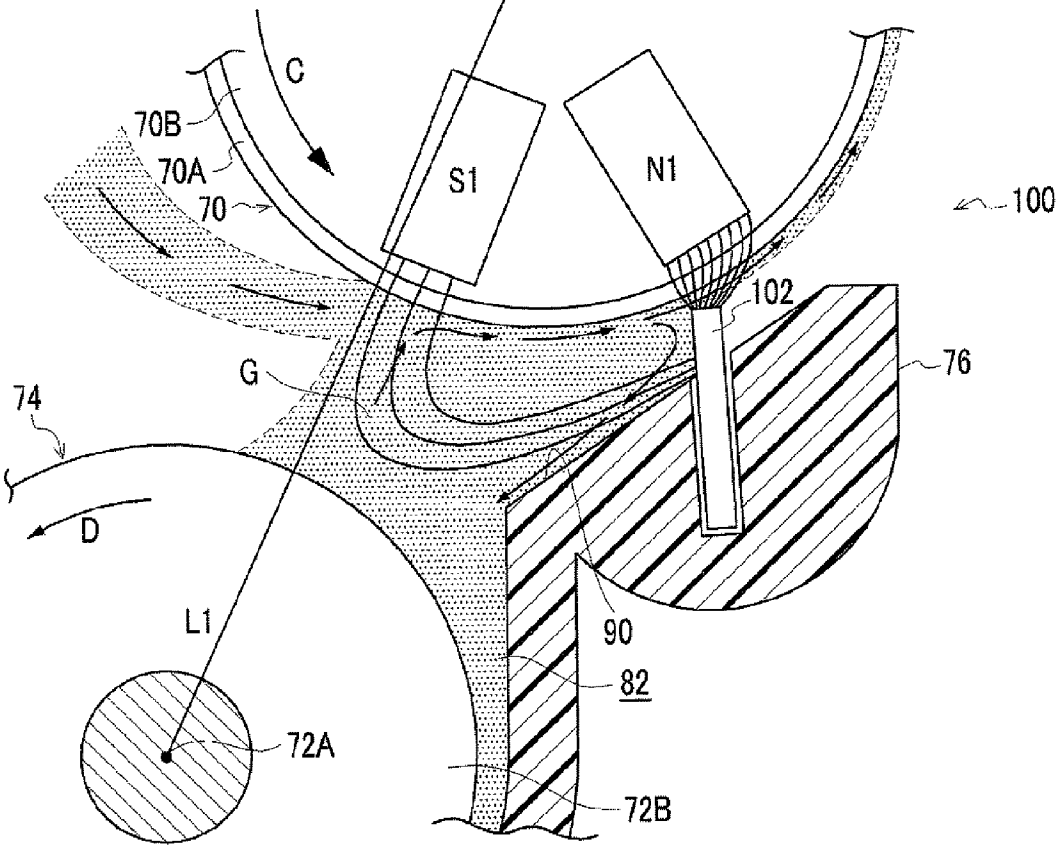
FIG. 5 is a view showing the flow of a developer and the magnetic lines of force in the vicinity of a scooping pole of a developing device as a comparative example of the developing device according to the exemplary embodiment of the invention.

FIG. 4 is a view schematically showing the flow of a developer G and the magnetic lines of force in the vicinity of the scooping pole S1 of the developing device 22 according to this exemplary embodiment. FIG. 5 is a view schematically showing the flow of a developer G and the magnetic lines of force in the vicinity of a scooping pole S1 of a developing device 100 as a comparative example of the developing device 22.

Since a columnar layer thickness regulating member 88 formed of a magnetic member is provided on the downstream side of the scooping pole S1 as shown in FIG. 4, the magnetic lines of force, which assist the scoop-up of the developer G performed by the scooping pole S1, are generated by a layer thickness regulating pole N1.

Meanwhile, when a magnetic member 102 having the shape of a rectangular plate is used as a layer thickness regulating member as shown in FIG. 5, the magnetic lines of force generated from a layer thickness regulating pole N1 are concentrated on the magnetic member 102 and the magnetic lines of force, which assist the scoop-up of a developer G performed by a scooping pole S1, are not generated. For this reason, the magnetic pole of the scooping pole S1 needs to be set strong. As a result, the developer G having been used for development is apt to be scooped up by the scooping pole S1 without being agitated and transported by the first or second agitation transport auger 72 or 74.

In the developing device 22 according to this exemplary embodiment, the layer thickness regulating member 88 is formed of a columnar magnetic member F and the magnetic lines of force, which assist the scoop-up of the developer G performed by the scooping pole S1, are generated by the layer thickness regulating pole N1. Accordingly, the magnetic pole of the scooping pole S1 is set weak by the magnetic lines of force to be generated. For this reason, the scoop-up of the developer G having been used for development, which is performed by the scooping pole S1 without the agitation and transport of the developer performed by the first or second agitation transport auger 72 or 74, is suppressed.

Figure 6:
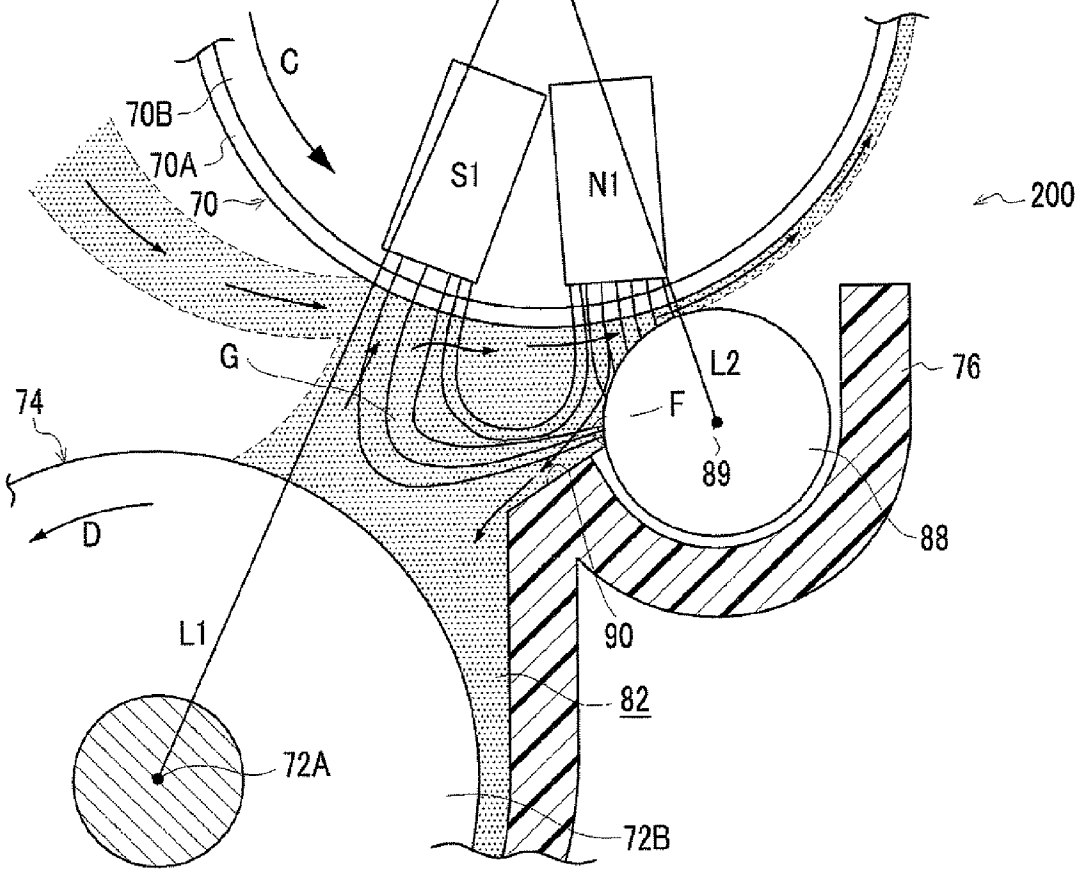
FIG. 6 is a view showing the flow of a developer and the magnetic lines of force in the vicinity of a scooping pole of a developing device as a comparative example of the developing device according to the exemplary embodiment of the invention.

FIG. 6 is a view showing the flow of a developer G and the magnetic lines of force in the vicinity of a scooping pole S1 of a developing device 200 as a comparative example of the developing device 22.

In the developing device 200 as a comparative example, a layer thickness regulating pole N1 is disposed so as to be offset to the upstream side of the line L2 in the rotation direction of the rotation sleeve 70A. In this case, the magnetic lines of force, which exist on the upstream side of the layer thickness regulating member 88, are directed to the direction of the layer thickness regulating member 88 than the direction parallel to the circumferential direction of the rotation sleeve 70A. For this reason, the fluidity of the developer G on the upstream side of the layer thickness regulating member 88 does not become active that much, and the developer G regulated by the layer thickness regulating member 88 is received in the first agitation passage 84.

Meanwhile, in the developing device 22 according to this exemplary embodiment, a layer thickness regulating pole N1 is disposed so as to be offset to the downstream side of the line L2 in the rotation direction of the rotation sleeve 70A as described above. In this case, as shown in FIG. 4, the magnetic lines of force, which exist on the upstream side of the layer thickness regulating member 88, are parallel to the circumferential direction of the rotation sleeve 70A. For this reason, the fluidity of the developer G on the upstream side of the layer thickness regulating member 88 becomes active, and a part of the developer G regulated by the layer thickness regulating member 88 is received in the first agitation passage 84. However, the rest of the developer G flows to the vicinity of the scooping pole S1 and is scooped up by the scooping pole S1 again.

That is, the scooping circulation where the developer G regulated by the layer thickness regulating member 88 is scooped up by the scooping pole S1 again occurs on the upstream side of the layer thickness regulating member 88. The scooping circulation operates so as to block the scoop-up of the developer G that has been used for development due to the scooping pole S1. As a result, the layer thickness regulating pole N1 is disposed so as to be offset to the downstream side of the line L2 in the rotation direction of the rotation sleeve 70A, so that the scoop-up of the developer G having been used for development, which is performed by the scooping pole S1 without the agitation and transport of the developer performed by the first or second agitation transport auger 72 or 74, is suppressed.

Further, even though the developer G having been used for development is scooped up by the scooping pole S1 without being agitated, the developer G is agitated on the upstream side of the layer thickness regulating member 88 since the fluidity of the developer G on the upstream side of the layer thickness regulating member 88 is active (scooping circulation occurs). Accordingly, the generation of density unevenness in the development of the electrostatic latent image is suppressed.

Meanwhile, an image forming apparatus, which includes the intermediate transfer belt 32 and performs primary transfer and secondary transfer, has been described in the image forming apparatus 10 according to this exemplary embodiment. However, the invention may also be applied to an image forming apparatus that directly transfers a toner image held on the image holding body 18 to a sheet member P.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device, comprising:

a developing member (1) that includes a scooping pole generating magnetic lines of force to scoop up a developer, (2) that rotates while holding the developer scooped up by the scooping pole on a surface thereof, and (3) that supplies the developer to an image holding body on which an electrostatic latent image is formed to develop the electrostatic latent image; and an agitation transport unit (1) that is disposed at a position where a developer used for development that has separated and fallen from the developing member is received, (2) that rotates about a center rotating shaft extending along a direction parallel to a rotating shaft of the developing member, (3) that agitates the developer, and (4) that transports the agitated developer to a scoop position where the developer is scooped up by the scooping pole, wherein a majority of the scooping pole is disposed on a downstream side of a line that connects the rotating shaft of the developing member with the rotating shaft of the agitation transport unit, in a rotation direction of the developing member when seen in a rotation axis direction of the developing member, wherein the line intersects the scooping pole, and wherein the scooping pole is disposed lower than a separation pole of the developing member in a gravity direction.

2. The developing device according to claim 1, further comprising:

a layer thickness regulating member (1) that is formed of a magnetic member, (2) that has a columnar shape, (3) that is disposed at a downstream position of the scooping pole in the rotation direction of the developing member so as to face the developing member with a gap between the layer thickness regulating member and the developing member, and (4) that comes into contact with a developer held on the surface of the developing member to regulate the layer thickness of the developer, a columnar shaft of the layer thickness regulating member extending along a direction parallel to the rotating shaft of the developing member.

3. The developing device according to claim 2, wherein the developing member is provided at a position facing the layer thickness regulating member, and includes a layer thickness regulating pole that generates magnetic lines of force toward the layer thickness regulating member, and wherein the layer thickness regulating pole is disposed so as to be offset to the downstream side of a line that connects the rotating shaft of the developing member with the columnar shaft of the layer thickness regulating member, in the rotation direction of the developing member when seen in the rotation axis direction of the developing member.

4. An image forming apparatus comprising:

an image holding body on which an electrostatic latent image is formed;

a developing device according to claim 3 that develops the electrostatic latent image formed on the image holding body; and a transfer device that transfers an image developed by the developing device to a transfer object body.

5. An image forming apparatus comprising:

an image holding body on which an electrostatic latent image is formed;

a developing device according to claim 2 that develops the electrostatic latent image formed on the image holding body; and a transfer device that transfers an image developed by the developing device to a transfer object body.

6. An image forming apparatus comprising:

an image holding body on which an electrostatic latent image is formed;

a developing device according to claim 1 that develops the electrostatic latent image formed on the image holding body; and a transfer device that transfers an image developed by the developing device to a transfer object body.

7. The developing device according to claim 1, wherein the developing member further includes a development pole, and wherein, when seen in the rotation axis direction of the developing member, the scooping pole, the development pole, and the separation pole are sequentially provided in a counter-clockwise direction around the rotation axis of the developing member.

8. The developing device according to claim 1, wherein the scooping pole is disposed between the separation pole and the rotating shaft of the agitation transport unit in the gravity direction.

9. The developing device according to claim 1, wherein the scooping pole is separated from the developer used for development as it falls from the developing member.

* * * * *